United States Patent [19]

Morishita et al.

[11] Patent Number: 4,938,084

[45] Date of Patent: Jul. 3, 1990

[54] STARTER FOR AN INTERNAL COMBUSTION ENGINE

[75] Inventors: Akira Morishita; Shuzoo Isozumi, both of Himeji, Japan

[73] Assignee: Mitsubishi Denki Kabushiki Kaisha, Tokyo, Japan

[21] Appl. No.: 392,317

[22] Filed: Aug. 11, 1989

Related U.S. Application Data

[62] Division of Ser. No. 278,401, Dec. 1, 1988.

[30] Foreign Application Priority Data

| | | | |
|---|---|---|---|
| Dec. 26, 1987 | [JP] | Japan | 62-197808 |
| Jan. 8, 1988 | [JP] | Japan | 63-1533 |
| Feb. 26, 1988 | [JP] | Japan | 63-25276 |

[51] Int. Cl.[5] ..... F02N 11/00

[52] U.S. Cl. ..... 74/6; 74/7 R; 123/179 M

[58] Field of Search ..... 74/6, 7 R, 7 B, 7 C, 74/7 E; 123/179 M

[56] References Cited

U.S. PATENT DOCUMENTS

| | | | |
|---|---|---|---|
| 4,304,140 | 12/1981 | Ebihara | 74/7 A |
| 4,412,457 | 11/1983 | Colvin et al. | 74/7 E |
| 4,573,364 | 3/1986 | Divan | 74/7 E |
| 4,590,811 | 5/1986 | Kasubuchi | 74/7 E |

FOREIGN PATENT DOCUMENTS

| | | | |
|---|---|---|---|
| 476647 | 9/1951 | Canada | 74/6 |

*Primary Examiner*—Dwight Diehl
*Assistant Examiner*—Scott Anchell
*Attorney, Agent, or Firm*—Sughrue, Mion, Zinn, Macpeak & Seas

[57] ABSTRACT

A starter for an internal combustion engine is disclosed which comprises a motor, an output shaft operatively coupled to the armature shaft of the motor, and an axially slidable assembly splined to the output shaft and including an overrunning clutch and a hollow shaft having a pinion formed at the front end thereof.

According to a first aspect of the invention, at least a portion of the pinion, the teeth of which have a top surface of substantial circumferential width, is, when the hollow shaft is at the extreme rear position, received into and supported by an annular ball bearing which is mounted to the front frame to rotatably and axially slidably support the hollow shaft. According to a second aspect, the rear side surface of the ball bearing mounted to the front frame to support rotatably the hollow shaft abuts against the front side of the clutch to stop the forward movement of the axially slidably assembly. According to a third aspect, the output shaft forms an integral front extension of the armature shaft of the motor, and a stopper, i.e. an outwardly extending flange formed on the outer circumferential surface of the hollow shaft, abuts against the rear side of the annular bearing to stop the forward movement of the axially slidably assembly. The axially backward reaction acting on the output shaft at the splined portion from the axially slidable assembly is countered by an axially forward force generated by the axially backward deviated position of the armature of the motor with respect to the field magnets, or, alternatively, by an annular frustoconical leaf spring which is mounted to the rear bracket and bears against an annular disk mounted to a rear end portion of the armature shaft.

2 Claims, 7 Drawing Sheets

STARTER FOR AN INTERNAL COMBUSTION ENGINE

This is a division of application Ser. No. 278,401, filed Dec. 1, 1988.

BACKGROUND OF THE INVENTION

1. The present invention relates to a starter for an internal combustion engine of an automobile.

2. Description of the Prior Art

Starters for an internal combustion engine generally comprise a D.C. electric motor, an output shaft coupled to the electric motor, and a hollow cylindrical assembly carrying the pinion and mounted coaxially on the output shaft. This pinion-carrying hollow cylindrical assembly is slid axially forward and is driven by the output shaft when the engine is to be started. In this front position of the pinion-carrying hollow cylindrical assembly, the pinion engages and drives the ring gear of the associated internal combustion engine.

FIG. 1 shows a typical structure of a conventional starter in which the output shaft forms an integral extension of the armature shaft of the electric motor. The armature shaft 1*a* of the D.C. electric motor 1 is extended forward to form an output shaft 2 integral therewith. The hollow cylindrical pinion carrying assembly mounted coaxially around the output shaft 2 includes a overrunning clutch 3 and a hollow shaft 4 having a pinion 5 formed at the front end thereof. The rear extension 3*d* of the outer member 3*a* of the clutch 3 engages with the helical splines 2*a* formed on the enlarged diameter portion of the output shaft 2 at the keyways formed on the inner surface thereof. The inner member 3*b* of the clutch 3 driven by the outer member 3*a* through rollers 3*c* forms an integral rear portion of the pinion-carrying hollow shaft 4, which is rotatably and axially slidably supported by sleeve bearings 6 on the output shaft 2. The hollow shaft 4 is further rotatably and axially slidably supported by a ball bearing 7 within the front frame 8. An electromagnetic switch device 9, when activated, rotates a shift lever 10 through a plunger rod 9*a* to slide the clutch 3 forward together with the pinion-carrying hollow shaft 4 on the output shaft 2 so that the pinion 5 is engaged with the ring gear (not shown) of the engine. The forward movement of the pinion-carrying shaft 4 is stopped and limited by a ring-shaped stopper 11 fixedly secured to the front end of the output shaft 2 by means of a ring 11*a* fitted into a groove 2*b* formed on the output shaft 2.

FIG. 2 shows another typical structure of a conventional starter which is similar to that shown in FIG. 1. In the case of the starter of FIG. 2, however, the output shaft 2 is a separate member which is coupled to the armature shaft 1*a* of the electric motor through the intermediary of a planetary reduction gear train (not shown). Otherwise, the starter of FIG. 2 is similar to that of FIG. 1, like reference numerals representing similar parts or portions.

The conventional starters as described above suffer disadvantages because of the structure in which the forward movement of the pinion-carrying hollow shaft 4 is limited by the stopper 11 which is mounted to the end portion of the output shaft 2 by means of the ring 11*a* fitted into the groove 2*b*. Namely, this structure requires that the output shaft 2 include an additional length for the disposition of the stopper 11, and this additional length of the output shaft 2 increases the overall dimension of the starter. Further, the disposition of the stopper 11 increases the number of parts and steps necessary for assembling the starter, which results in increased production cost thereof.

In view of these disadvantages of conventional starters, a structure shown in FIG. 3 has already been proposed to improve the starter of FIG. 1 in which the output shaft forms an integral extension of the armature shaft of the electric motor. The starter of FIG. 3 has a structure similar to that shown at FIG. 1 (with exceptions to be described below), like reference numerals representing like parts or portions. In the starter of FIG. 3, however, the forward movement of the pinion-carrying hollow shaft 4 is stopped and limited by an annular flange 4*a* formed at a rear portion thereof. That is, the flange 4*a* abuts against the bearing 7 to stop the forward sliding movement of the hollow shaft 4 when the electromagnetic switch device 9 is activated and the rotation of the shift lever 10 slides the clutch 3 and the hollow shaft 4 to the front position. Thus, the stopper 11 of FIG. 1 can be dispensed with, and above-mentioned disadvantages of conventional starters can be eliminated.

The structure according to FIG. 3, however, suffer another kind of problem, as described below.

As described above, when the engine is started, the electromagnetic switch 9 is activated to turn the lever 10 and the pinion-carrying hollow shaft 4 is slid forward together with the clutch 3, so that the flange 4*a* abuts against the bearing 7 and the pinion 5 engages with the ring gear (not shown) of the engine. At the same time, the electric motor 1 is activated to rotate the pinion-carrying hollow cylindrical assembly. Thus the rotation of the output shaft 2 is transmitted to the outer member 3*a* of the clutch 3 through the rear extension 3*d* thereof engageing with the helical splines 2*a* formed on the output shaft 2. Further, the rotation of the outer member 3*a* of the clutch 3 is transmitted through the rollers 3*c* to the rear extension 3*b* of the hollow shaft forming the inner member of the clutch 3. In this transmission of the rotational force from the electric motor to the pinion engaging with the ring gear of the associated engine, due to the fact that the rotation of the output shaft 2 is transmitted to the clutch 3 by means of helical splines 2*a*, the rotational force of the output shaft 2 not only results in a rotational force on the clutch 3, but also results in an axial force which drives the clutch 3 (and the pinion carrying hollow shaft 4 together therewith) axially forward. This axial driving force is born by the flange 4*a* abutting against the bearing 7. The reaction from the bearing 7 transmitted through the hollow shaft 4 and the clutch 3 acts on the output shaft 2 at the helical splines 2*a*, and drives the armature shaft 1*a* in the axially backward direction. Thus, the rear end surface of the cummutator 1*b* of the motor 1 is pressed against the ring-shaped washed 12 by this backward reaction which is equal to the axial driving force arising at the helical splines 2*a*. The friction between the commutator 1*b* and the washer 12 brings about a loss of output torque which is equal to: (the diameter of the washer 12)×(the axial force arising at the helical splines 2*a*)×(-the coefficient of friction between the commutator 1*b* and the washer 12). This torque loss substantially diminishes the output power of the starter.

In addition to the disadvantages described above, conventional starters all have the following disadvantage. Namely, since the outer surface of the pinion-carrying hollow shaft 4 is rotatably and axially slidably supported by the bearing 7, the hollow shaft 4 (hence the output shaft 2) requires an additional axial length for the bearing 7, thereby increasing the size and weight of the starter.

SUMMARY OF THE INVENTION

A first object of the present invention is to provide a starter for an internal combustion engine which is small in size and light in weight. More paricularly, it is a first object of the present invention to provide a starter for an internal combustion engine having a reduced axial dimension.

A second object of the present invention is to provide a starter for an internal combustion engine which, as well as being reduced in axial dimension, requires a reduced number of parts and assembling steps so that the production cost can be reduced.

A third object of the present invention is to provide a starter for an internal combustion engine in which the output shaft forms an integral extension of the armature shaft of the electric motor, whereby the axial dimension of the starter is shortened, the number of necessary parts and assembling steps is reduced, and the loss of output torque resulting from the friction at the rear end of the commutator of the motor is minimized.

According to the present invention, a starter for an internal combustion engine is provided which comprises an electric motor accommodated in a cylindrical yoke, an output shaft operatively coupled to the front end of the armature shaft of the electric motor, and an axially slidable hollow cylindrical assembly disposed coaxially around the output shaft. The axially slidable assembly includes a hollow cylindrical member splined to the output shaft, and a hollow shaft coupled thereto through a one-way clutch and having a pinion formed at the front end thereof which engages with the ring gear of the engine. The hollow shaft, which is rotatably and axially slidably supported on the output shaft, is further supported, rotatably and axially slidably, by an annular bearing mounted to a central aperture of the front frame coupled to the cylindrical yoke accomodating the motor.

According to a first aspect of the present invention, the top (i.e. outer) portions of the teeth of the pinion formed at the front end of the hollow shaft forms circumferentially circular arc-shaped surfaces of a substantial circumferential width; further, the inner surface of the annular bearing is in contact at least partially with a portion of the circular acr-shaped top surfaces of the teeth of the pinion when the hollow shaft is at the extreme rear position. Thus, axial dimension of the hollow shaft, and hence that of the output shaft, can be sortened by a length approximately equal to the axial dimension of the annular bearing supporting the outer surface of the hollow shaft.

According to a second aspect of the present invention, the rear side surface of the annular bearing mounted to the front frame to rotatably and axially slidably support the hollow shaft abuts against the front side surface of the one-way clutch to stop the forward sliding movement of the axially slidably assembly (including the clutch and the hollow shaft) at the extreme front position at which the pinion engages with the ring gear of the engine. Thus, the ring-shaped stopper mounted to the front end portion of the output shaft can be dispensed with. Consequently, not only the axial dimension of the starter but also the number of parts and assembling steps can be reduced.

A third aspect of the present invention applies to the starter in which the output shaft forms an integral front extension of the armature shaft of the electric motor. According to this third aspect of the present invention, a stopper member formed on the axially slidable assembly abuts against the rear side surface of the annular bearing to stop the forward movement of the assembly at the extreme front postion at which the pinion engages with the ring gear of the engine; further, an urging means is provided which urges the armature shaft of the electric motor in the axially forward direction, at least during the time when the electric motor is in rotation, to counteract the axially backward driving force acting on the splined portion of the output shaft from the axially slidably assembly which is being driven by the output shaft through the splines. The stopper member may be an outwardly extending flange formed on the outer circumferential surface of the hollow shaft in front of the clutch. The urging means, on the other hand, may be constituted by a relative position of the armature of the electric motor which is axially backwardly deviated with respect to the axial position of the field magnets thereof; alternatively, the urging means may be constituted by a spring which is mounted on the rear bracket coupled to the central yoke and bears on a rear end portion of the armature shaft to urge it axially forward. According to the third aspect of the present invention, the axial dimension of the starter can be shortened, the number of parts and assembling steps is reduced, and the loss of output torque die to friction is minimized.

BRIEF DESCRIPTION OF THE DRAWINGS

The novel features which are characteristic of the present invention are set forth with particularity in the appended claims. However, further details of the present invention according to the three aspects thereof, both as to its organization and operation, together with further advantages thereof, will be best understood by reference to the following detailed description of the preferred embodiments, in which:

In the drawings like reference numerals represent like or corresponding parts or portions.

DETAILED DESCRIPTION OF THE PREFERRED EMBODIMENTS

Figure 4:
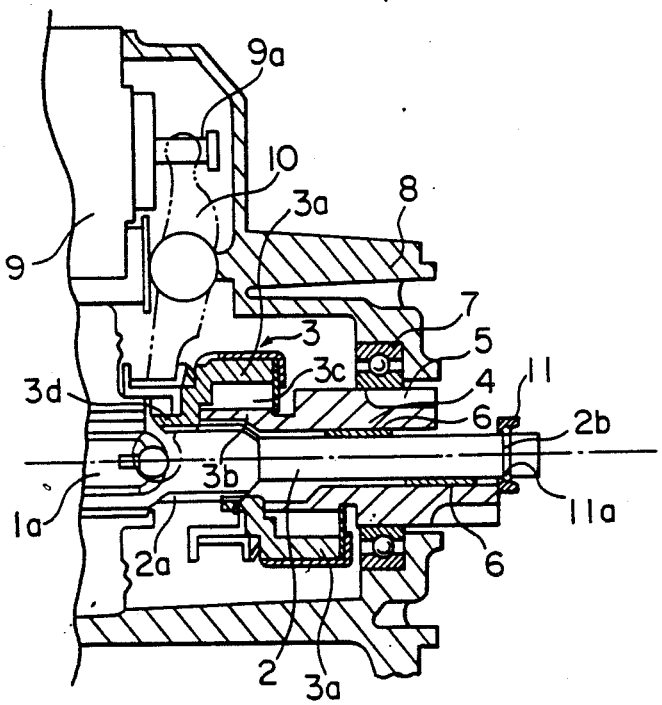
FIG. 4 is a view similar to that of FIG. 2, but showing an embodiment according to a first aspect of the present invention.

Referring now to FIGS. 4 andd 5 of the drawings, an embodiment according to the first aspect of the present invention is described.

Figure 1:
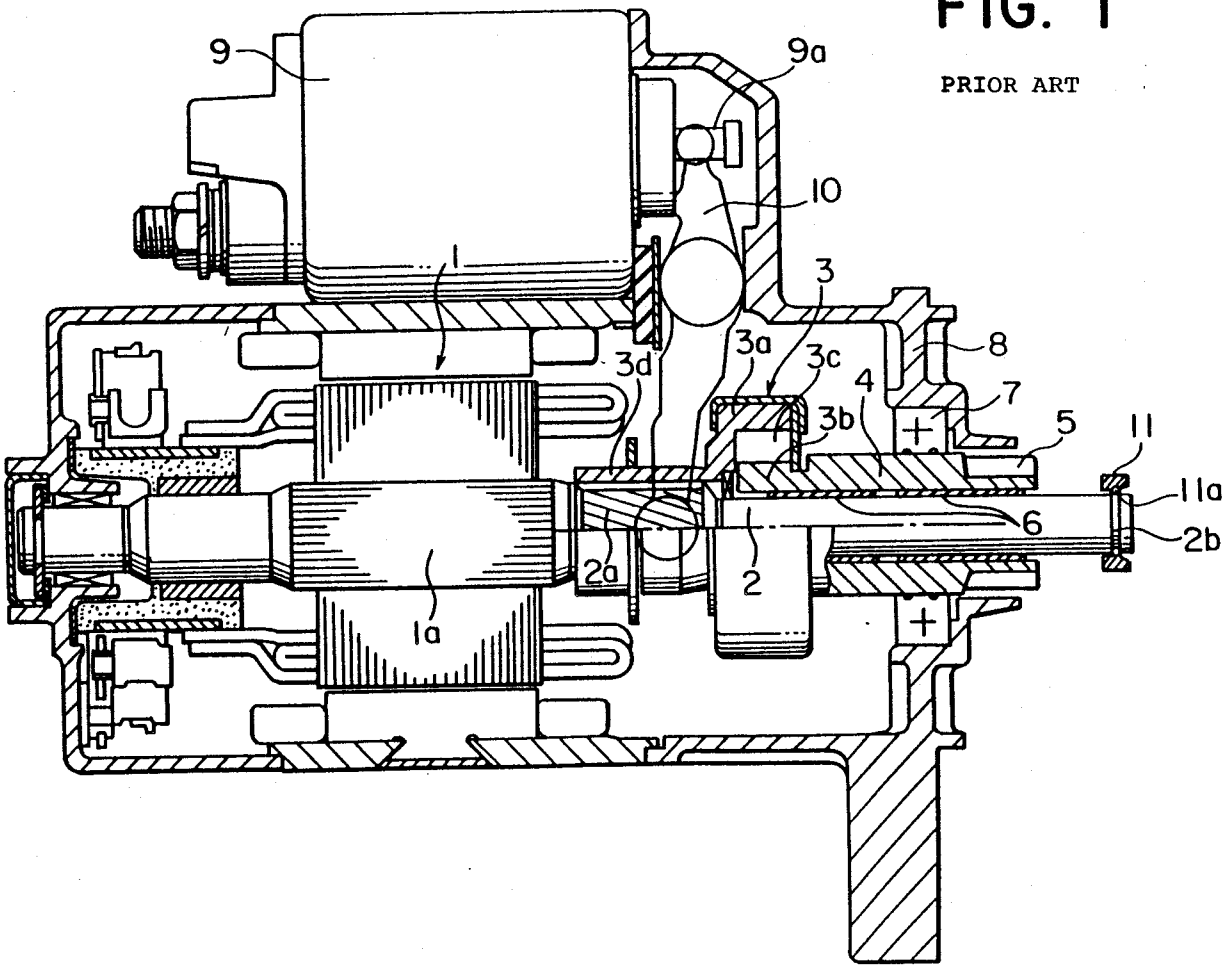
FIG. 1 PRIOR ART
FIG. 1 is an axial sectional view of a conventional starter for an internal combustion engine in which the output shaft forms an integral front entension of the armature shaft of the electric motor.
Figure 2:
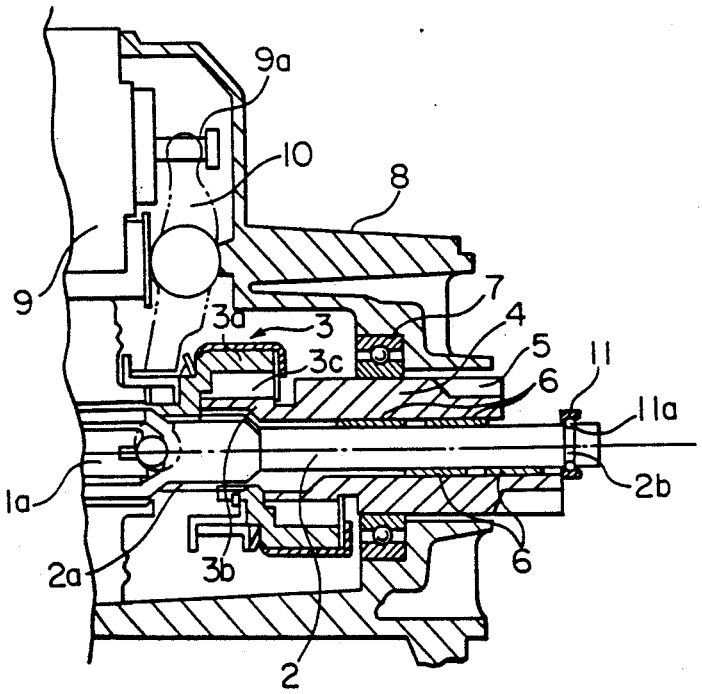
FIG. 2 PRIOR ART
FIG. 2 is a partial axial sectional view of another conventional starter in which the output shaft is operatively coupled to the armature shaft of the electric motor through a planetary reduction gear train, whereby the figure shows the output portion of the starter in which the upper and lower half of the pinion-carrying hollow shaft are represented at the extreme rear and front position thereof, respectively.

FIG. 4 shows the output portion of the starter according to the first embodiment which is similar the starter of FIG. 2. Thus, an output shaft 2 is coupled to an armature shaft 1*a* of the D.C. electric motor through the intermediary of a planetary reduction gear train (not shown). The axially slidable hollow cylindrical pinion-carrying assembly mounted coaxially around the output shaft 2 includes an overrunning clutch 3 and a hollow shaft 4 having a pinion gear 5 formed at the front end thereof. A hollow cylindrical integral rear extension 3*d* of the outer member 3*a* of the clutch 3 has helical keyways formed on the inner surfacce thereof, which engage with the equally spaced helical keys (i.e. helical splines) 2*a* formed on a rear enlarged diameter portion of the output shaft 2. On the other hand, the hollow shaft 4 having an integral rear extension forming the inner member 3*b* of the clutch 3 is rotatably and axially slidably supported on a front portion of the output shaft 2 through a sleeve bearing 6. The overrunning clutch 3 transmits rotational motion in one direction from the outer member 3*a* to the inner member 3*b* thereof through rollers 3*c*. The hollow cydinder 4 is further rotatably and axially slidably supported at the outer circumferential surface thereof by a ball bearing 7 which is mounted within the central aperture of the front frame 8, which is coupled to the hollow cylindrical yoke accommodating the electric motor. An electromagnetic switch 9, when activated, rotates the shift lever 10 through a plunger 9*a*, to slide the clutch 3 together with the pinion-carrying hollow shaft 4 to the extreme front position (as shown below the central axis of the output shaft 2 in the figure) at which the front end of the hollow shaft 4 abuts against the stopper 11 mounted on a front end portion of the output shaft 2 through a ring 11*a* fitted into an annular groove 2*b* formed on the output shaft 2. The pinion 5 engages and drives the ring gear (not shown) of the engine at this front position.

Figure 5:
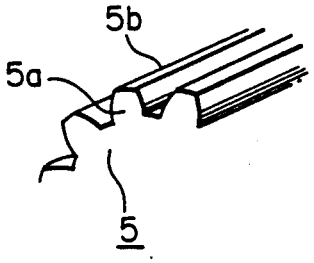
FIG. 5 is a partial perspective view of the pinion of the starter of FIG. 4.

According to the first aspect of the present invention, the hollow shaft 4 is in sliding contact with and supported by the inner surface of the bearing 7 partly at a portion of the outer surface thereof at the rear side of the pinion 5 and partly at a portion of the outer surfaces of the teeth of the pinion 5 when the hollow shaft 4 is at the extreme rear position as shown above the central axis of the output shaft 2 in FIG. 4. Thus, as shown in FIG. 5, the top 5*b* of the teeth 5*a* of the pinion 5 forms a circular arc-shaped surface of a substantial circumference thereby increasing the area at which the top or outer surfaces 5*b* of the teeth 5*a* are in sliding contact with the inner surface of the ring-shaped ball bearing 7. This increased contact area between the top surfaces 5*b* of the teeth 5*a* of the pinion 5 and the bearing 7 improves the reliability of the pinion 5 and the whole axially slidable pinion-carrying assembly against oscillations. Incidentally, the ball bearing 7 is made of a stainless steel which has a high corrosion resistant property.

It is evident from the comparison of FIGS. 2 and 4 that the axial length of the hollow shaft 4 can be shortened substantially by an amount approximately equal to the axial dimension of the bearing 7 according to the first aspect of the present invention, according to which the hollow shaft 4 is supported by the bearing 7 at least partly at the top surfaces of the teeth of the pinion 5 when the hollow shaft 4 is at the extreme rear position. Consequently, the axial length of the output shaft 2, and hence the overall size and weight of the starter, can be substantially reduced.

Figure 6:
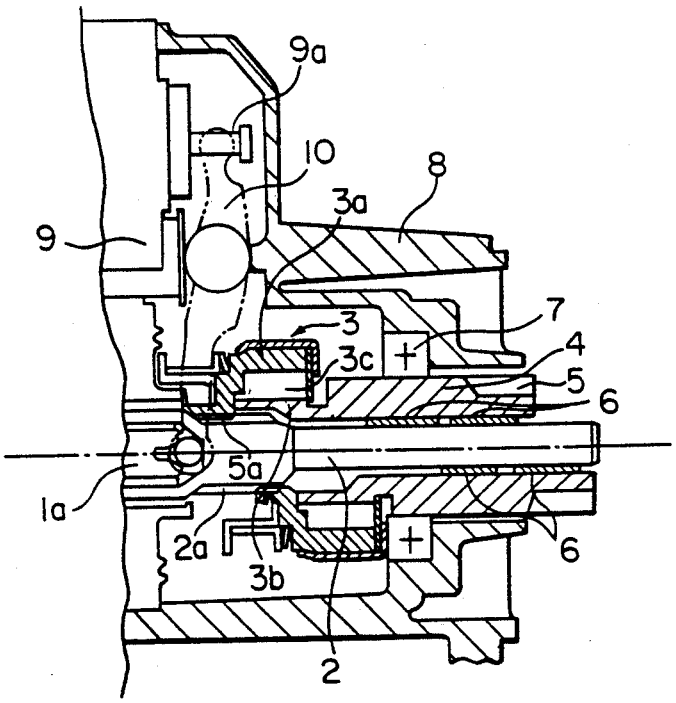
FIG. 6 is a view similar to those of FIGS. 2 and 4, but showing an embodiment according to a second aspect of the present invention.

Next, referring to FIG. 6 of the drawings, an emdodiment according to the second aspect of the present invention is described. The starter of FIG. 6 is also similar to that of FIG. 2, and the description of the starter of FIG. 4 applies thereto (with exceptions to be described below), like reference numerals representing similar portions or parts. However, the stopper 11 of FIG. 2 is dispensed with in the case of the starter of FIG. 6, and as shown in the lower half of FIG. 6, the front side surface of the clutch 3 abuts against the bearing 7 when the hollow cylindrical axially slidable assembly (including the clutch 3 and the hollow shaft 4) is at the extreme front position. In other words, the bearing 7 stops the forward movement of the clutch 3 and limits the extreme front position of the axially slidable assembly by abutting against the front side surface of the clutch 3. The bearing 7, which is secured to the central aperture of the front frame 8 and supports rotatably and axially slidably the outer side surface of the hollow cylinder 4, consists of angular contact ball bearing. Thus, the bearing 7 can sustain the thrust load in the axially forward direction applied thereto from the abutting clutch 3. Thus, the bearing 7 can stop and limit the axially forward movement of the clutch 3 and the hollow shaft 4 with high reliability. The bearing 7, however, may consist of any type of bearing which can sustain thrust loads in the axial direction with high reliability. Further, the structure of FIG. 6 may be modified so that a portion of the thrust load from the clutch 3 is born by the front frame 8. Still further, the elimination of the stopper 11 of FIG. 2 mounted to the front end of the output shaft 2 in this embodiment makes it easier to attach a dust-proof cap to the front end of the pinion 5 to prevent dust from entering into the gap between the hollow shaft 4 and the output shaft 2.

Figure 7:
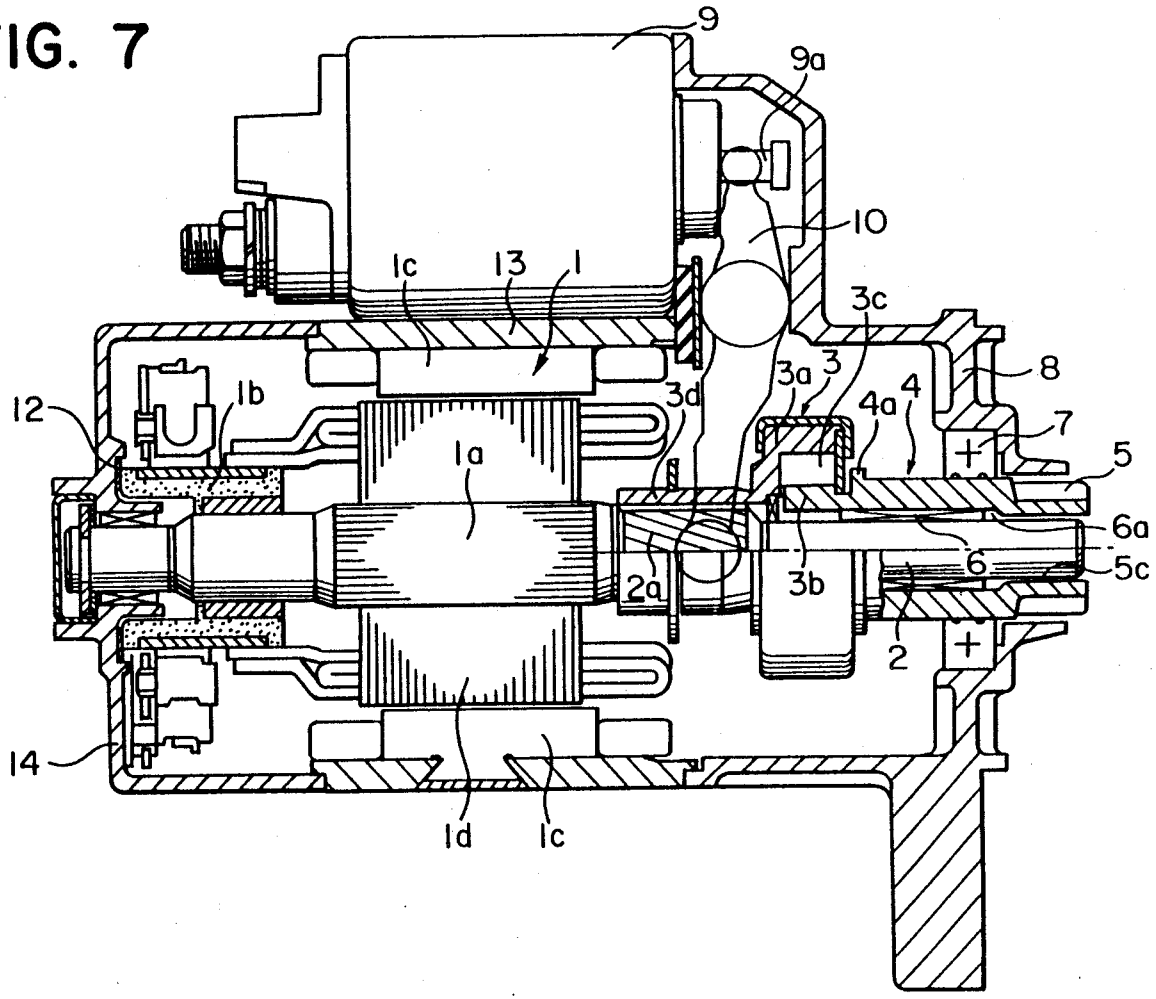
FIG. 7 is a view similar to that of FIGS. 1 and 3, but showing a first embodiment according to a third aspect of the present invention, which is an improvement over the starter of FIG. 3.
Figure 8:
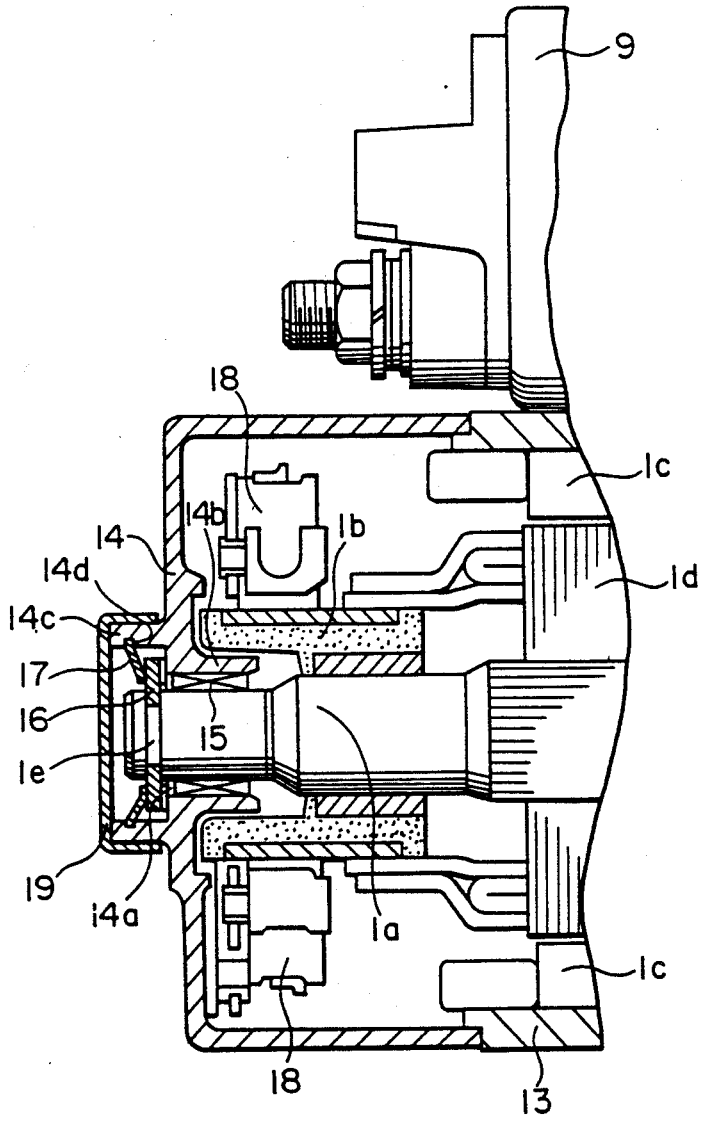
FIG. 8 is a partial axial sectional view of a second embodiment according to the third aspect of the present invention, showing the rear portion of the starter.

Referring next to FIGS. 7 and 8 of the drawings, embodiments according to the third aspect of the present invention is described.

Figure 3:
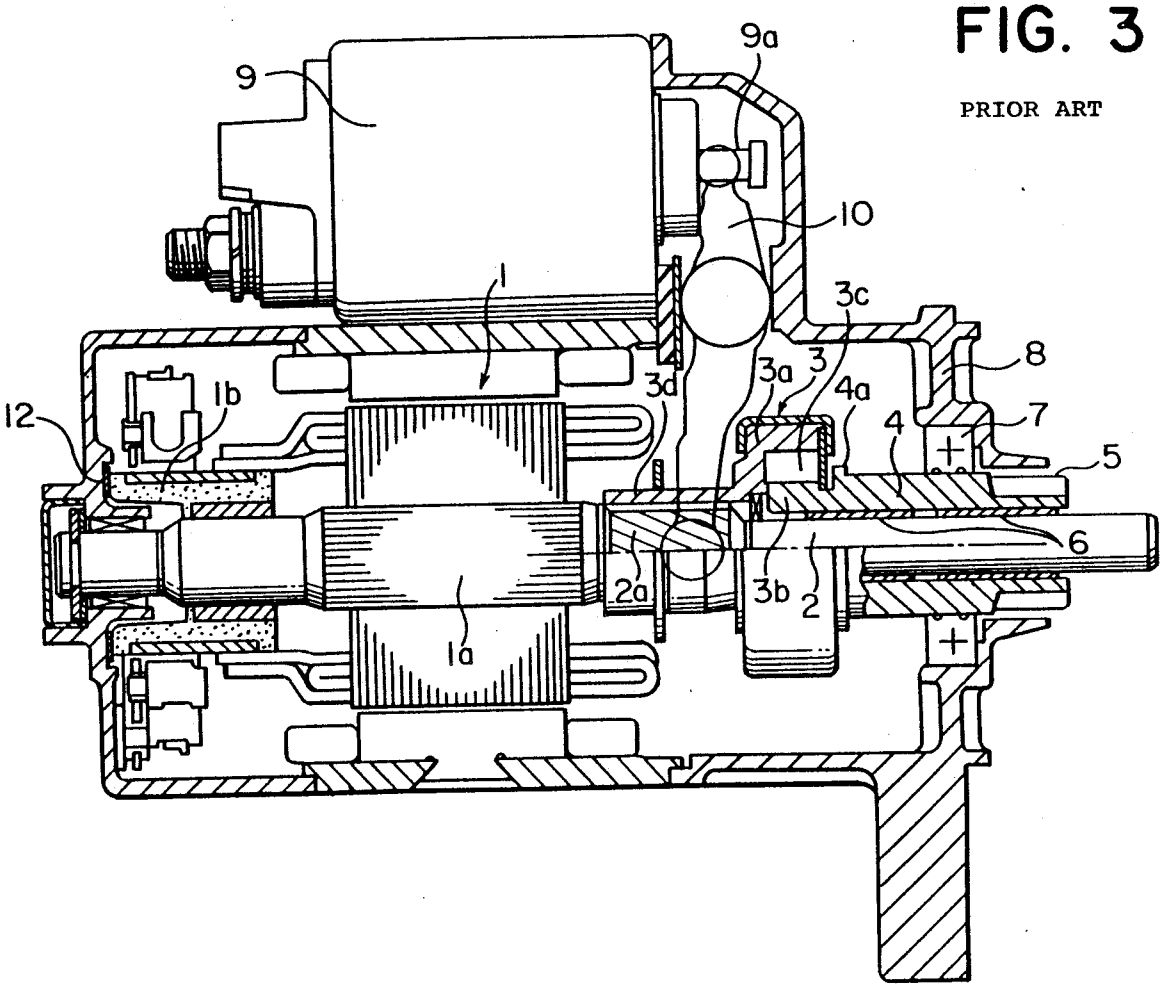
FIG. 3 PRIOR ART
FIG. 3 is a view similar to that of FIG. 1, but showing a modification of the starter of FIG. 1.

FIG. 7 shows a first embodiment according to the third aspect of the present invention which is similar to the starter of FIG. 3. Thus, the output portion of the starter of FIG. 7 comprises an output shaft 2 forming an integral front extension of the armature shaft 1*a* of the electric motor 1, and an axially slidable assembly including an overrunning clutch 3 and a hollow shaft 4 having a pinion 5 formed at the front end thereof. A hollow cylindrical rear extension 3*d* of the outer member 3*a* of the clutch 3 axially slidably engages at the helical keyways formed on the inner surface thereof with the helical splines 2*a* formed on the enlarged diameter portion to the output shaft 2. The hollow shaft 4, on the other hand, is coaxially supported on the output shaft 2 by a sleeve bearing 6 disposed in a relatively wide gap 6*a* formed between the outer surface of the output shaft 2 and the inner surface of the enlarged inner diameter rear portion of the hollow cylinder 4. The front portion of the hollow shaft 4 under the pinion 5 forms a reduced inner diameter portion which opposes the outer surface of the output shaft 2 at the inner surface thereof across a small clearance 5c. Thus, the axial position of the sleeve bearing 6 is relatively deviated to the rear from the center of the hollow shaft 4. Consequently, the bearing 6 stops at a relatively backward axial position even when the hollow shaft 4 is advanced to the extreme front position at which the radially outwardly extending flange 4a formed on the outer surface of the hollow shaft 2 in front of the clutch 3 abuts against the bearing 7. Thus, it becomes possible to reduce the axial length of the output shaft 2 to such an extent that the front end of the output shaft 2 is axially receded with respect the axial position of the front end of the pinion-carrying hollow shaft 4 at its extreme rear position as shown in FIG. 7. Thus, the axial position of the front end of the output shaft 2 is irrelevant in determining the overall dimension of the starter.

When activated, an electromagnetic switch 9 turns the shift lever 10 through the plunger 9a to move the clutch 3 and the hollow shaft 4 to the extreme front position in which the flange 4a abuts against the bearing 7 and the pinion 5 engages with the ring gear (not shown) of the engine. The bearing 7 consists of an angular contact ball bearing and reliably sustains the thrust load exerted from the flange 4a.

The D.C. electric motor 1 accommodated in a cylindrical yoke 13 comprises a pluralilty of circumferentially spaced field magnets 1c mounted to the inner surface of the yoke 13, and an aramature 1d mounted on the armature shaft 1a. The rear end of the commutator 1b electrically coupled to the armature windings of the armature 1d abuts in sliding contact against an annular washer 12 mounted in the cup-shaped rear bracket 14 coupled to yoke 13. According to the third aspect of the present invention, the axial position of the armature 1d is deviated axially backward with respect to the position of the field magnets 1c. The reason of this axially backward deviation of the position of the armature 1d is as follows. As has been explained in the introductory portion of this specification in connection with the starter of FIG. 3, the helical splines 2a exert an axially forward driving force to the hollow cylindrical extension 3d of the outer membr 3a of the clutch 3 when it rotates and drives the axially slidably assembly including the clutch 3 and the hollow cylinder 4. This axially forward driving force is born by the bearing 7 abutting against the flange 4. Thus, the armature shaft 1a and the output shaft 2 forming an integral extension thereof receives an axially backward reaction at the helical splines 2a from the axially slidable assembly including the clutch 3 and the shaft 2. The axially backward deviated position of the armature 1d with respect to the field magnets 1c results in an axially forward force from the field magnets 1c to the armature 1d when the armature windings of the armature 1d are energized. Namely, the magnetic force exerted on the axially deviated armature 1d has a component in the axial forward direction as well as the torque component. This axially forward force component acting on the armature 1d counteracts the reaction from the axially slidable assembly acting at the helical splines 2a. Thus, these two opposing axial forces acting on the axially fixed assembly (including the armature shaft 1a and the output shaft 2), cancel each other, and the resultant thereof becomes negligible. Consequently, the friction between the rear end of the commutator 1b and the washer 12 is minimized, and reduction of the output torque of the starter can be prevented.

FIG. 8 shows the rear portion of a second embodiment according to the third aspect of the present invention which comprises a leaf spring at the rear end of the armature shaft of the motor as a means for counteracting the reaction at the helical splines on the armature shaft. The output portion of the starter of FIG. 8 is similar to that of FIG. 7, while the electric motor portion (i.e. the portion including the armature and field magnets accomodated within the central yoke 13) thereof is similar to that of FIG. 3, whereby like reference numerals represent similar portions or parts. The rear portion of the starter of FIG. 8, on the other hand, is constructed as follows. The rear end portion of the armature shaft 1a of the electric motor extends through a central opening 14a of the cup-shaped rear bracket 14 which is defined by an axially inwardly extending annular flange 14b thereof, and is rotatably supported by a bearing 15 mounted to the inner surface of the flange 14b. The rear bracket 14 coupled to the central cylindrical yoke 13 at the front end thereof further comprises an axially outwardly extending integral flange 14d which surrounds the rear end portion of the armature shaft 1a extending outwardly from the opening 14a of the bracket 14. A frustoconical annular disk-shaped leaf spring 17, which is mounted into an annular groove 14d formed in the inner surface of the outward flange 14d of the rear bracket 14 at the outer peripheral portion (or the base) thereof extends radially inwardly with an axially forward tilting, bears at the inner peripheral portion (or the top) thereof against an annular disk-shaped washer 16 secured into an annular groove 1e formed on the outer surface of the rear end portion of the armature shaft 1a extending from the opening 14a. Thus, the annular leaf spring 17 urges the armature shaft 1a in the forward axial direction to counteract the reaction in the axially backward direction which acts on the armature shaft 1a from the axially slidable assembly at the helical splines when the axially slidable assembly is driven by the motor. Thus, the rear end of the commutator 1b which is supplied with an electric power from brushes 18 is kept away from the rear bracket 14, so that no friction arises between the commutator 1b and the rear bracket 14. A cap 19 is fitted on the outward flange 14d to prevent dust from entering into the interior.

While description has been made of particular embodiments according to three aspects of the present invention, it will be understood that many modifications may be made without departing from the spirit thereof; the appended claims are contemplated to cover any such modifications as fall within the true spirit and scope of the present invention.

What is claimed is:

1. A starter for an internal combustion engine comprising:

an electric motor including an armature amounted on an armature shaft and accommodated in a cylindrical yoke;

a front frame coupled to an output side of said cylindrical yoke and having a central aperture;

an output shaft operatively coupled on a front end of an armature shaft of said electric motor to be driven and rotated;

a hollow cylindrical member coaxially disposed around and axially slidably splined to a portion of said output shaft;

a hollow shaft coaxially and rotatably and axially slidably supported around a portion of said output shaft at a front side of said hollow cylindrical member splined to the output shaft;

a pinion gear formed at a front end of said hollow shaft and adapted to engage with a ring gear of the internal combustion engine;

a one-way clutch axially slidably disposed around said output shaft and coupling said hollow cylindrical member and said hollow shaft to transmit rotational motion in one rotational direction; and an angular contact ball bearing mounted to said central aperture of said front frame and rotatably and axially slidably supporting said hollow shaft extending therethrough;

wherein a rear side surface of said angular contact bearing abuts against a front side surface of said one-way clutch to stop a forward sliding movement of said clutch and the hollow shaft at an extreme front position of the hollow shaft at which said pinion gear engages with said ring gear of the internal combustion engine.

2. A starter for an internal combustion engine as claimed in claim 1, further comprising means for sliding said hollow cylindrial member, hollow shaft, and one-way clutch on said output shaft to said extreme front position in which said pinion engages with the ring gear of the internal combustion engine.

* * * * *